US007290473B2

(12) United States Patent
Kitamura

(10) Patent No.: US 7,290,473 B2
(45) Date of Patent: Nov. 6, 2007

(54) PIERCE CAM

(75) Inventor: Noritoshi Kitamura, Hirakata (JP)

(73) Assignee: Umix Co., Ltd., Hirakata-shi (JP)

( * ) Notice: Subject to any disclaimer, the term of this patent is extended or adjusted under 35 U.S.C. 154(b) by 0 days.

(21) Appl. No.: 10/885,692

(22) Filed: Jul. 8, 2004

(65) Prior Publication Data

US 2005/0072287 A1 Apr. 7, 2005

(30) Foreign Application Priority Data

Oct. 2, 2003 (JP) ..... 2003-344676

(51) Int. Cl.
*B26D 5/00* (2006.01)
*B26F 1/14* (2006.01)

(52) U.S. Cl. ..... 83/143; 83/618; 83/627; 83/684

(58) Field of Classification Search ..... 83/549, 83/618, 684, 531–541, 258, 356.2, 356.3, 83/435.19, 435.25, 437.6, 437.7, 604, 111, 83/143–145, 129, 134, 135, 627–635
See application file for complete search history.

(56) References Cited

U.S. PATENT DOCUMENTS 702,698 A * 6/1902 Bowen ..... 83/167
1,478,684 A * 12/1923 Taylor et al. ..... 83/435.19
3,205,742 A * 9/1965 Williamson ..... 83/140
3,811,171 A * 5/1974 Grube ..... 29/56.6
3,987,695 A * 10/1976 Neilsen ..... 83/522.17
4,428,262 A * 1/1984 Vlahek ..... 83/139
4,645,399 A * 2/1987 Scharer ..... 412/16
4,757,589 A * 7/1988 Nakano ..... 29/243.5
4,987,811 A * 1/1991 Ikarashi et al. ..... 83/372
4,993,295 A * 2/1991 Dacey, Jr. ..... 83/140
5,279,197 A * 1/1994 Takeda et al. ..... 83/631
5,992,285 A * 11/1999 Talarico ..... 83/684
2004/0237748 A1* 12/2004 Potthoff et al. ..... 83/684

* cited by examiner

*Primary Examiner*—Kenneth E. Peterson
*Assistant Examiner*—Phong Nguyen
(74) *Attorney, Agent, or Firm*—Birch, Stewart, Kolasch & Birch, LLP

(57) ABSTRACT

A pierce cam is compact, can save space, can be easily mounted, can reduce cost, can even be mounted to a sloped surface, and a pierce punch and required accessories can be ordered in bulk from a single source. A pierce cam includes a pierce punch, a body which is detachably provided with the pierce punch, a stripper which is fitted to the pierce punch inward of a leading end portion of the pierce punch and is biased by a coil spring in a direction away from the body, a rotating arm which is swingably mounted on the body and is movable into contact with a rear end surface of the pierce punch, and a driver which transfers a descending force of a press machine to the rotating arm, and hooks and ascends the rotating arm at the time of moving upward.

8 Claims, 9 Drawing Sheets

PIERCE CAM

This Non-provisional application claims priority under 35 U.S.C. § 119(a) on Patent Application No(s). 2003-344676 filed in Japan on Oct. 2, 2003, the entire contents of which are hereby incorporated by reference.

BACKGROUND OF THE INVENTION

1. Field of the Invention

The present invention relates to a pierce cam, and more particularly to a standardized piece cam.

2. Description of Background Art

A conventional pierce cam is constituted, as shown in FIG. 16, by a pierce punch 101, a punch plate 102 which holds the pierce punch 101, a stripper 103 which presses a work W before piercing by the pierce punch 101 and takes away the pierce punch 101 from the work W after piercing, a cushion rubber (there is a case of a coil spring) 104 which presses the stripper 103, a passive cam 105 which mounts the punch plate 102 thereto and moves backward and forward toward the work W, an actuating cam 106 which moves forward the passive cam 105, a base plate block 107 which slides and holds the passive cam 105, and serves as a heel in the case that the actuating cam 106 drives the passive cam 105, and a coil spring 108 which returns the passive cam 105.

The passive cam 105, the actuating cam 106 and the base plate block 107 are made of cast metal, require a wide space and are expensive.

As mentioned above, the conventional pierce cam is large-scaled, requires a lot of space, is hard to be mounted, is expensive, and is hard to be mounted to a slope surface.

Further, since the pierce punch 101, the passive cam 105, the actuating cam 106 and the base plate block 107 are generally ordered from different makers, it is impossible to order in a lump and it is inconvenient in view of production control.

SUMMARY OF THE INVENTION

An object of the present invention is to provide a pierce cam which is compact, can save space, can be easily mounted, can reduce a cost, and can even be mounted to a sloped surface, and in which a pierce punch and required accessories can be ordered in bulk from a single source.

Taking the matters mentioned above into consideration, in order to make it possible to make the structure compact, save space, be easily mounted, reduce a cost, be mounted to a sloped surface and order a pierce punch and required accessories in bulk from a single source, in accordance with the present invention, there is provided a pierce cam comprising a pierce punch, a body which is detachably provided with the pierce punch, a stripper which is fitted to the pierce punch inward of a leading end portion of the pierce punch and is biased by a coil spring in a direction away from the body, a rotating arm which is swingably mounted on the body and is movable into contact with a rear end surface of the pierce punch, and a driver which transfers a descending force of a press machine to the rotating arm, and hooks and ascends the rotating arm at the time of moving upward.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A detailed description of the present invention will be given below on the basis of a specific embodiment shown in the accompanying drawings.

Figure 1:
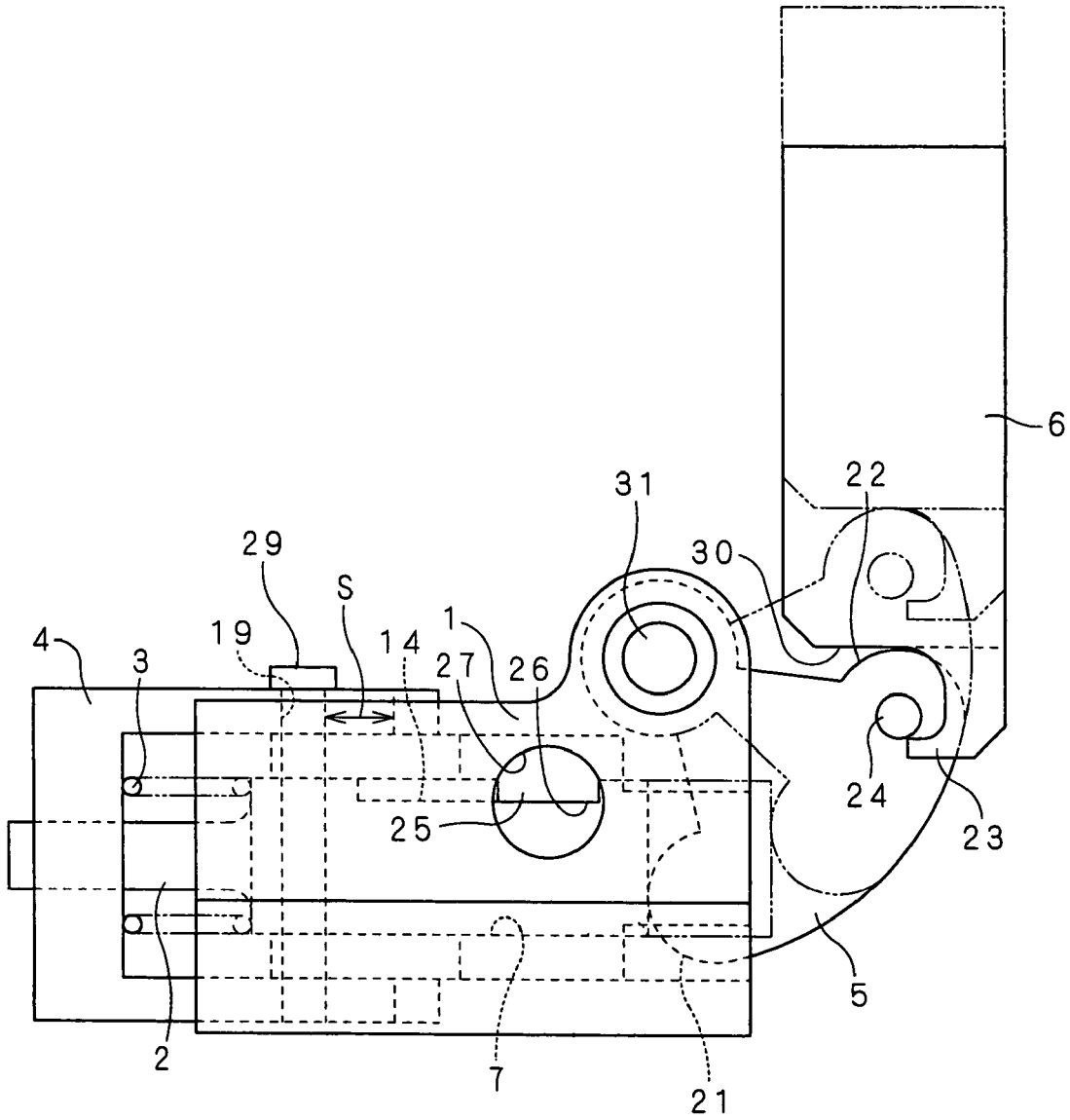
FIG. 1 is a front elevational view of a pierce cam in accordance with a specific embodiment of the present invention.
Figure 2:
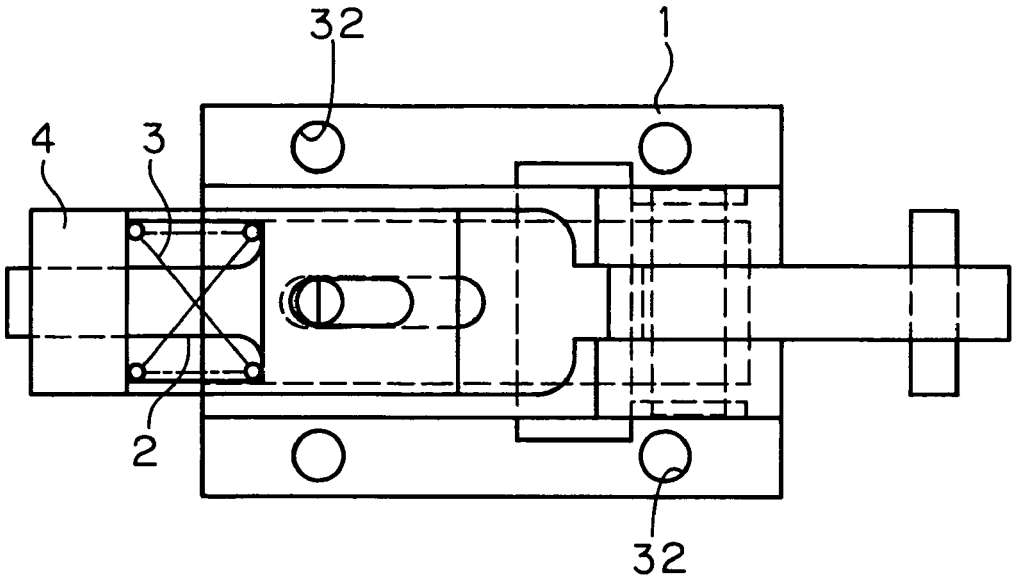
FIG. 2 is a plan view excluding a driver.

FIG. 1 is a front elevational view of a pierce cam in accordance with a specific embodiment of the present invention, and FIG. 2 is a plan view excluding a driver.

A pierce punch 2 is detachably provided in a body 1, a stripper 4 energized by a coil spring 3 is slidably provided in the body 1, an oscillating arm 5 is swingably pivoted to the body 1, a lower portion of the oscillating arm 5 is brought into contact with a rear end surface of the pierce punch 2, and a driver 6 provided in a trailing manner in an upper die transfers a downward moving force of a press machine to the oscillating arm 5, and hooks the rotating arm 5 at the time of moving upward.

Figure 3:
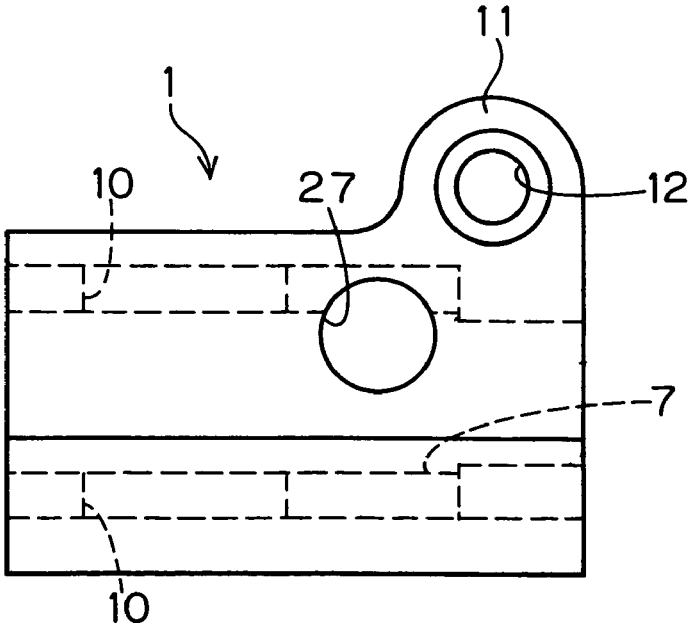
FIG. 3 is a front elevational view of a body.
Figure 4:
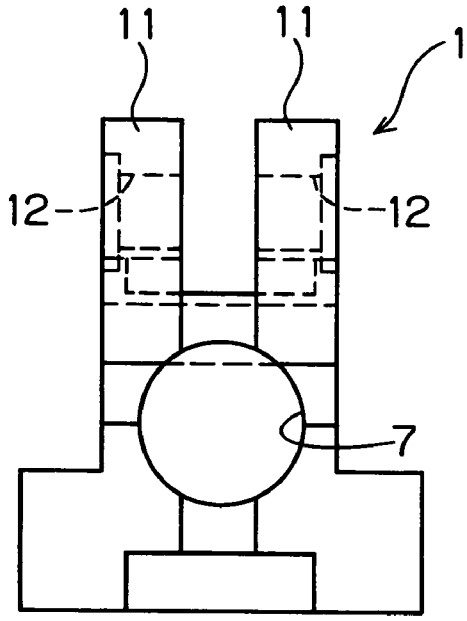
FIG. 4 is a side elevational view of the body.
Figure 5:
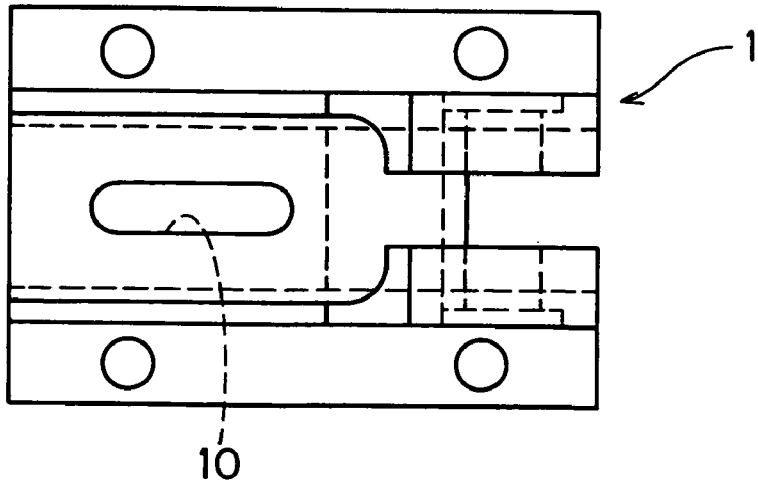
FIG. 5 is a plan view of the body.

Details of the body 1 will be shown in FIGS. 3 to 5. FIG. 3 is a front elevational view of the body 1, FIG. 4 is a side elevational view of the same and FIG. 5 is a plan view of the same.

A guiding hole 7 for attaching and detaching the pierce punch 2 is pierced in the body 1.

At the time of piercing by the pierce punch 2, a long hole 10 for mounting a stripper 4 which serves to press the work before piercing and take away the pierce punch 2 from the work after piercing is pierced in the body 1.

A bracket portion 11 provided with the oscillating arm 5 is pierced in an upper portion of a rear end of the body 1, and a mounting hole 12 is pierced in the bracket portion 11.

In this case, reference numeral 32 denotes a mounting hole for mounting to a lower die main body.

Figure 6:
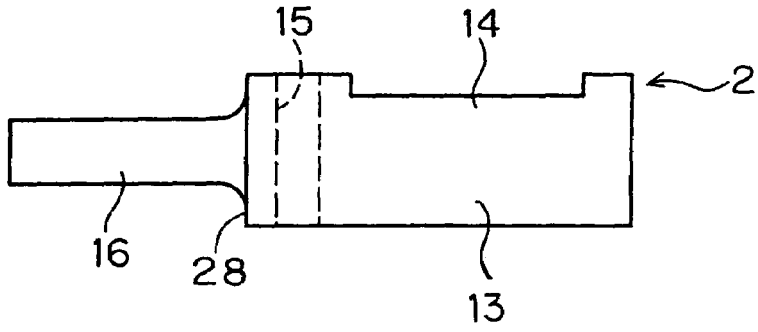
FIG. 6 is a front elevational view of a pierce punch.
Figure 7:
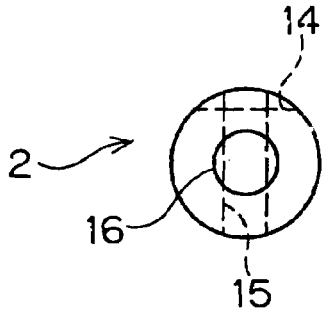
FIG. 7 is a side elevational view of the pierce punch.
Figure 8:
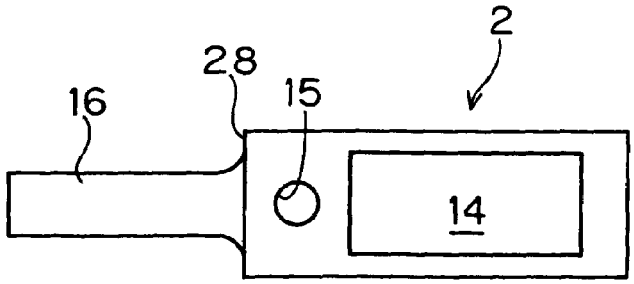
FIG. 8 is a plan view of the pierce punch.

Details of the pierce punch 2 will be shown in FIGS. 6 to 8. FIG. 6 is a front elevational view of the pierce punch 2, FIG. 7 is a side elevational view of the same and FIG. 8 is a plan view of the same.

The pierce punch 2 is structured such that a shaft portion 13 is formed into a circular shape so as to be attached to the guiding hole 7 of the body 1, and a flat surface 14 is formed in an intermediate portion of the shaft portion 13 so as to bring the pierce punch 2 into contact with a stopper surface not shown for fixing. Further, a positioning hole 15 is pierced in a front end portion of the shaft portion 13.

A seat portion 28 for the coil spring 3 is formed in a front end surface of the shaft portion 13 in accordance with a cutting operation.

Figure 9:
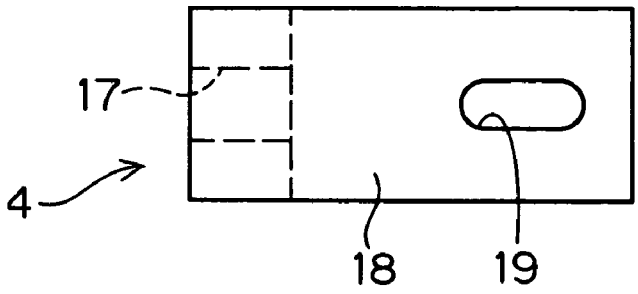
FIG. 9 is a front elevational view of a stripper.
Figure 10:
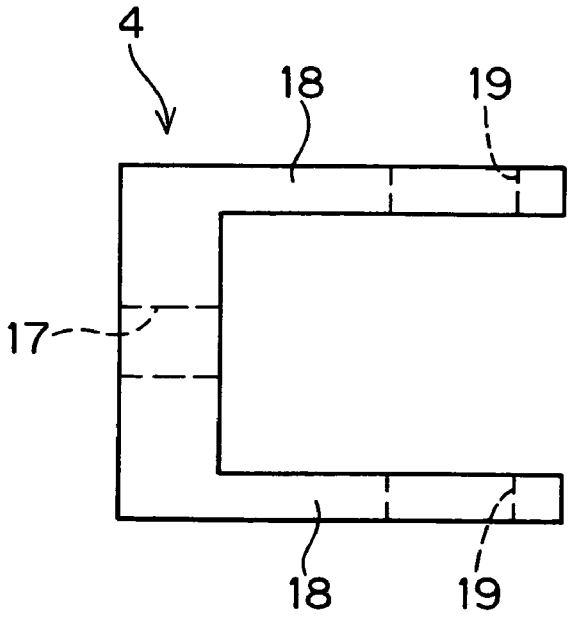
FIG. 10 is a plan view of the stripper.

Details of the stripper 4 will be shown in FIGS. 9 and 10. FIG. 9 is a front elevational view of the stripper 4 and FIG. 10 is a plan view of the same.

The stripper 4 is constituted by a copper casted product, and is formed in a C-shaped cross section, and an inner surface of a hole 17 to which a hole forming portion 16 of the pierce punch 2 is fitted is impregnated with a graphite such that the hole forming portion 16 of the pierce punch 2 can smoothly move.

A stroke length hole 19 for determining a stroke of the stripper 4 is pierced in both side walls 18 of the stripper 4.

Figure 11:
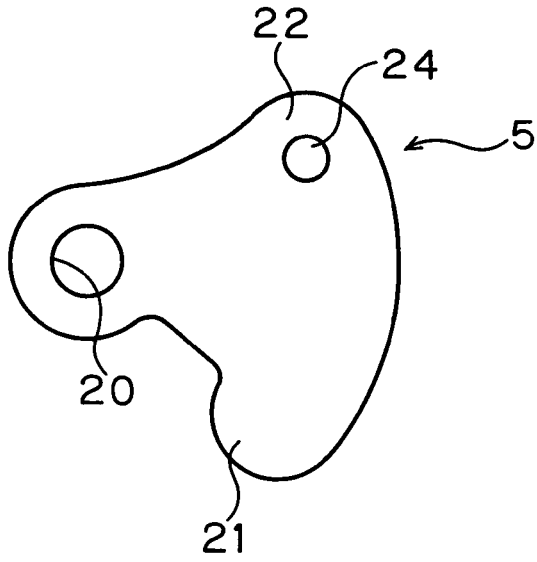
FIG. 11 is a front elevational view of an oscillating arm.

Details of the oscillating arm 5 will be shown in FIG. 11. The oscillating arm 5 is constituted by a fan-shaped plate-like body, a hole 20 is pierced in a center of oscillation, one end portion is formed in a circular arc contact portion 21 which is brought into contact with the rear end surface of the pierce punch 2, and another end portion is formed in a circular arc contact portion 22 which is brought into contact with the driver 6, respectively. Further, a pin 24 with which a hook 23 of the driver 6 is caught at a time of moving upward is provided in another end portion so as to protrude to both sides.

Figure 12:
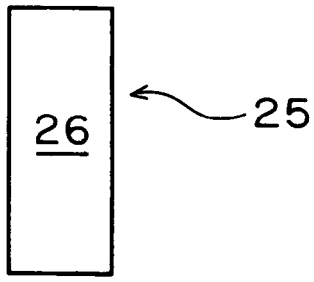
FIG. 12 is a front elevational view of a slide pin.
Figure 13:
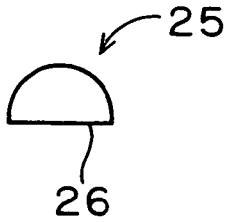
FIG. 13 is a plan view of the slide pin.

A slide pin 25 will be shown in FIGS. 12 and 13. FIG. 12 is a front elevational view of the slide pin 25, and FIG. 13 is a plan view of the same. The slide pin is used for attaching and detaching the pierce punch 2 to and from the body 1, and is formed by separating a circular column body into half and slightly cutting both sides of a flat surface 26.

The present pierce cam is assembled as follows.

The pierce cam is assembled by inserting the pierce punch 2 to the guiding hole 7 of the body 1, bringing the rear end surface thereof into contact with the stopper surface, bringing the flat surface 26 of the slide pin 25 into contact with the flat surface 14 of the pierce punch 2 so as to insert to an attaching and detaching hole 27 of the body 1, and fixing the pierce punch 2. In the case that it is necessary to replace the pierce punch 2 due to a nicked edge or the like, the slide pin 25 is taken out, the pierce pin 2 is replaced by a new pierce punch 2, and the slide pin 25 is inserted and fixed.

The slide pin 25 serves as a rotation prevention of the pierce punch 2 in the case that the hole forming of the pierce punch 2 is a shape other than a circular shape, for example, a rectangular shape, a hexagonal shape and the like.

Next, the coil spring 3 is seated on a seat portion 28 of the pierce punch 2, the hole forming portion 16 of the pierce punch 2 is fitted to the hole 17 of the stripper 4, and a stopper pin 29 is fitted to the stroke length hole 19 in the side wall 18 of the stripper 4 and the long hole 10 of the body 1. Since the stripper 4 is energized by the coil spring 3, the stripper 4 moves forward by a stroke S.

The oscillating arm 5 is pivoted by a pin 31 while the hole 20 thereof is brought into line with the mounting hole 12 in the bracket portion 11 of the body 1, the circular arc contact portion 21 thereof is brought into contact with the rear end surface of the pierce punch 2, and the pierce punch 2 and the oscillating arm 5 are pin connected (not shown) by a link.

A lower end surface 30 of the driver 6 firmly fixed to the upper die is brought into contact with the circular arc contact portion 22 of the oscillating arm 5, the oscillating arm 5 is rotated on the basis of the downward movement of the driver 6, and the circular arc contact portion 21 presses the rear end surface of the pierce punch 2 so as to push out the pierce punch 2 forward against an energizing force of the coil spring 3.

After the piercing process by the pierce punch 2, the upper die moves upward, the hook 23 of the driver 6 catches the pin 24 of the oscillating arm 5, rotates the oscillating arm 5 rearward and slides the flat surface 14 of the pierce punch 2 along the flat surface 26 of the slide pin 25, and the pierce punch 2 is returned backward.

Figure 14:
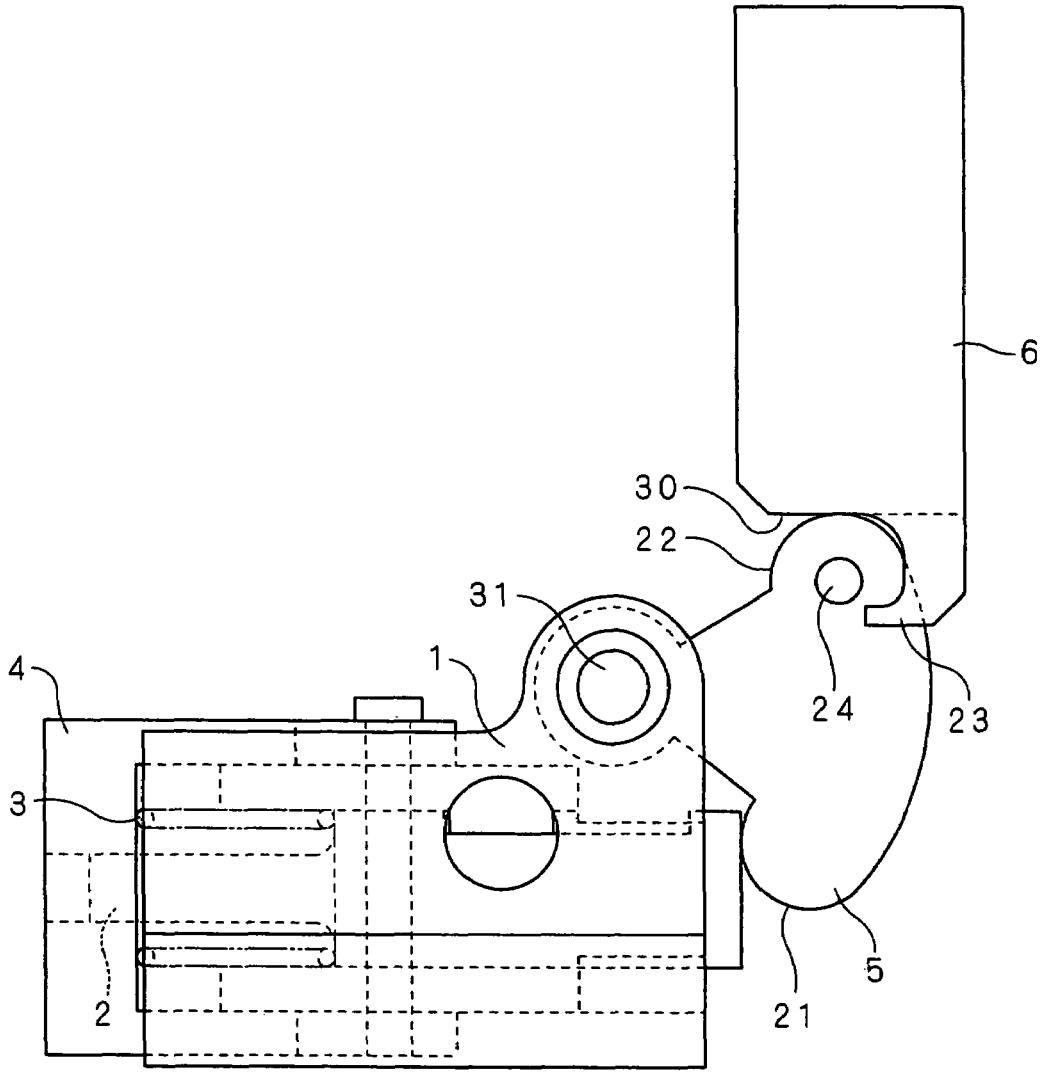
FIG. 14 is a front elevational view of the present pierce cam in a state in which the driver is moved upward.

FIG. 14 shows a state in which the driver 6 is moved upward.

Figure 15:
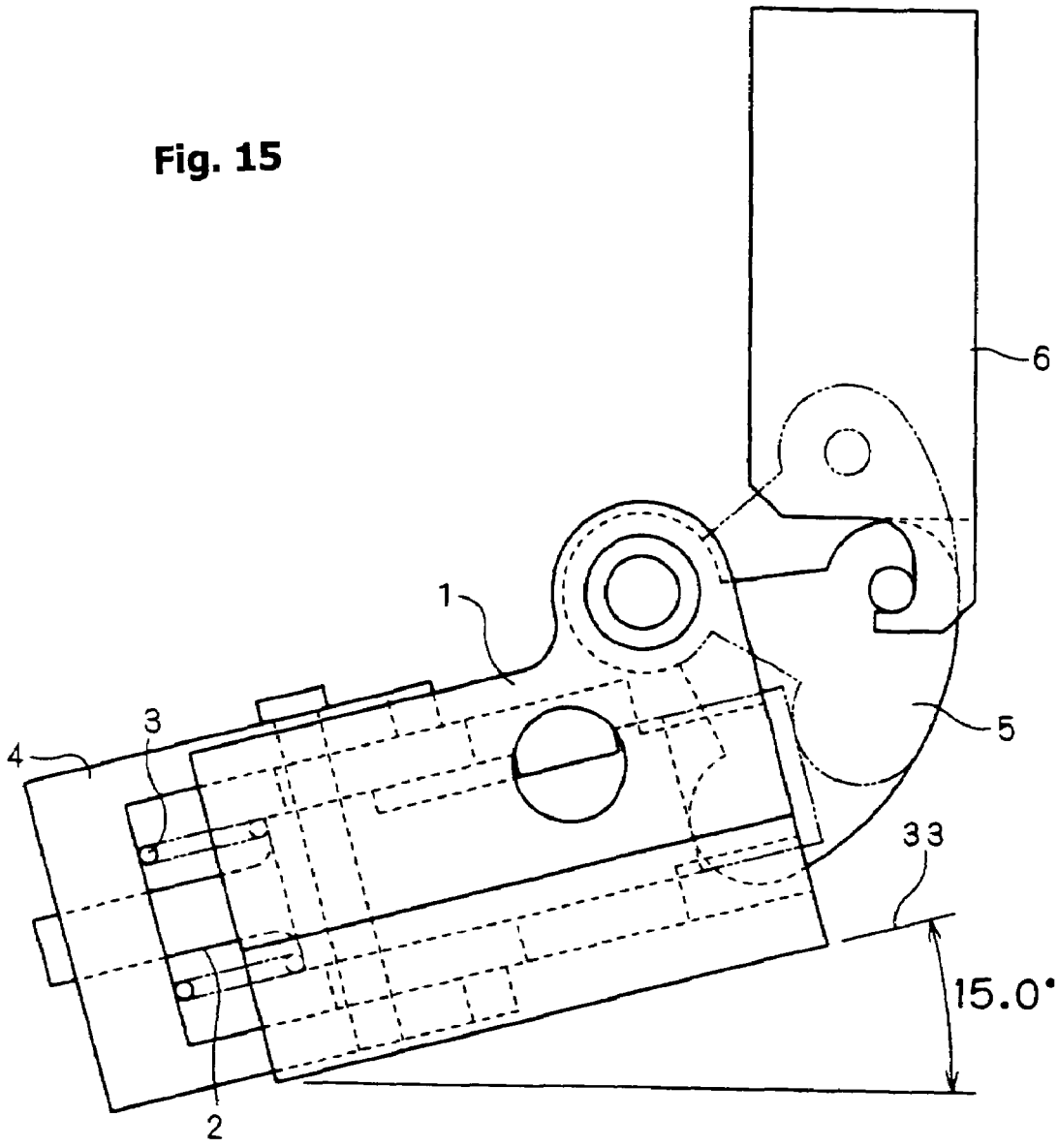
FIG. 15 is a front elevational view of a state in which the present pierce cam is mounted to a slope surface.
Figure 16:
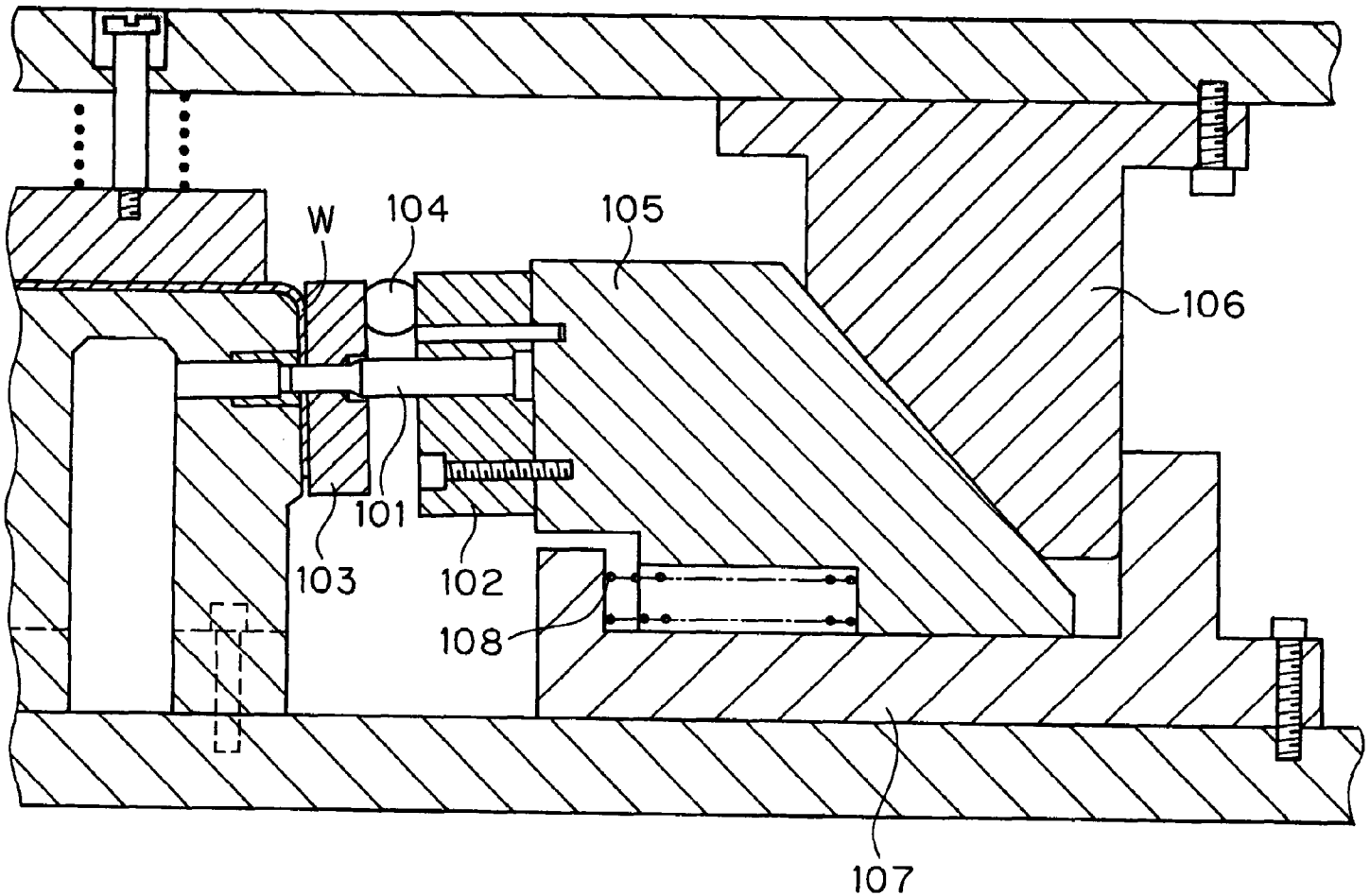
Fig. 16 BACKGROUND ART
FIG. 16 is a vertical cross sectional view of a conventional pierce cam.

The present pierce cam can be easily mounted even in the case that the mounting surface is even a slope surface 33 as shown in FIG. 15.

The piercing process by the present pierce cam can be easily applied to the structure having a hole diameter of 15 to 35 mm.

The present pierce cam can be utilized for piercing the thin plate formed product, however, can be utilized for piercing a plastic or the like in addition to the thin plate formed product.

Since the present invention provides the pierce cam comprising the pierce punch, the body which is detachably provided with the pierce punch, the stripper which is fitted to the pierce punch inward of the leading end portion of the pierce punch and is braised by the coil spring, the rotating arm which is swingably mounted on the body and is movable into contact with the rear end surface of the pierce punch, and the driver which transfers the descending force of the press machine to the rotating arm, and hooks and ascends the rotating arm at the time of moving upward, as mentioned above, it is possible to make the structure compact, save space, be easily mounted, reduce a cost, be mounted to a sloped surface and order the pierce punch and required accessories in bulk form from a single source.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pierce cam comprising:

a pierce punch;

a single one-piece body, said body detachably supporting the pierce punch;

a stripper, said stripper being fitted to the pierce punch inward of a leading end portion of the pierce punch and being mounted to the body for movement with respect thereto, said stripper being biased by a coil spring in a direction away from the body;

a rotating arm said rotating arm being swingably mounted on the body and movable into contact with a rear end surface of the pierce punch; and a driver, said driver for transferring a descending force of a press machine to the rotating arm and including a hook that hooks and ascends the rotating arm when the driver moves upward, wherein said rotating arm includes first and second circular arc contact points, said first circular arc contact portion being in operable with the rear end surface of the pierce punch and said second circular are contact portion being in operable contact with the driver.

2. The pierce cam according to claim 1, wherein said body includes:

a guiding hole formed therethrough for receiving the pierce punch;

a mounting hole formed therethrough for receiving a pin that swingably mounts said rotating arm; and a hole formed therethrough for receiving a pin that movably mounts said stripper.

3. The pierce cam according to claim 2, wherein said rotating arm includes a pin extending outwardly therefrom, said pin cooperating with the hook of the driver to ascend the rotating arm when the driver moves upward.

4. The pierce cam according to claim 3, wherein said stripper includes:

a hole formed therethrough that receives the pierce punch;

a pair of side walls, said pair of side walls being received on upper and lower surfaces of the body, each of said side walls including a stroke length hole formed therethrough that receives the pin for movably mounting the stripper to the body.

5. The pierce cam according to claim 4, wherein said pierce punch includes a shaft portion and a hole forming portion, said shaft portion being movably supported in said body and including a positioning hole formed therethrough, said positioning hole receiving the inn for movably mounting the stripper to the body, and said hole forming portion being received in a hole formed in said stripper.

6. The pierce cam according to claim 1, wherein said rotating arm includes a pin extending outwardly therefrom, said pin cooperating with the hook of the driver to ascend the rotating arm when the driver moves upward.

7. The pierce cam according to claim 1, wherein said stripper includes:

a hole formed therethrough that receives the pierce punch;

a pair of side walls, said pair of side walls being received on upper and lower surfaces of the body, each of said side walls including a stroke length hole formed therethrough that receives a pin for movably mounting the stripper to the body.

8. The pierce cam according to claim 1, wherein said pierce punch includes a shaft portion and a hole forming portion, said shaft portion being movably supported in said body and including a positioning hole formed therethrough, said positioning hole receiving a pin for movably mounting the stripper to the body, and said hole forming portion being received in a hole formed in said stripper.

* * * * *